US009022722B2

(12) United States Patent
Liu et al.

(10) Patent No.: US 9,022,722 B2
(45) Date of Patent: May 5, 2015

(54) FRAME ASSEMBLY OF RING-TYPE FAN WITH PRESSURE-RELEASING FUNCTION

(75) Inventors: Wen-Hao Liu, New Taipei (TW); Guan-Chen Yin, New Taipei (TW)

(73) Assignee: Asia Vital Components Co., Ltd., New Taipei (TW)

( * ) Notice: Subject to any disclaimer, the term of this patent is extended or adjusted under 35 U.S.C. 154(b) by 780 days.

(21) Appl. No.: 13/296,478

(22) Filed: Nov. 15, 2011

(65) Prior Publication Data

US 2013/0121840 A1 May 16, 2013

(51) Int. Cl.

| | |
|---|---|
| ***F04D 29/00*** | (2006.01) |
| ***F04D 25/06*** | (2006.01) |
| ***F04D 29/16*** | (2006.01) |
| ***F04D 29/32*** | (2006.01) |
| ***F04D 29/54*** | (2006.01) |

(52) U.S. Cl.

CPC ..... *F04D 25/0613* (2013.01); *F04D 29/164* (2013.01); *F04D 29/326* (2013.01); *F04D 29/542* (2013.01)

(58) Field of Classification Search

CPC .... F04D 29/164; F04D 29/326; F04D 29/667
USPC ..... 415/58.4, 58.5, 168.2, 168.4, 173.6; 416/174, 192, 189, 187, 179
See application file for complete search history.

(56) References Cited

U.S. PATENT DOCUMENTS

| | | | | |
|---|---|---|---|---|
| 4,548,548 | A * | 10/1985 | Gray, III | 416/189 |
| 5,489,186 | A * | 2/1996 | Yapp et al. | 415/58.7 |
| 5,577,888 | A * | 11/1996 | Capdevila et al. | 415/210.1 |
| 5,957,661 | A * | 9/1999 | Hunt et al. | 416/192 |
| 6,024,537 | A * | 2/2000 | Moreau et al. | 416/192 |
| 6,315,521 | B1 * | 11/2001 | Hunt | 416/192 |
| 6,579,063 | B2 * | 6/2003 | Stairs et al. | 416/169 A |
| 6,863,496 | B2 * | 3/2005 | Cho et al. | 415/173.5 |

* cited by examiner

*Primary Examiner* — Edward Look
*Assistant Examiner* — Adam W Brown

(57) ABSTRACT

A frame assembly of a ring-type fan with a pressure-releasing function includes a fan wheel, a pressuring-releasing portion, and a frame body. The fan wheel is received in an accommodating space of the frame body. The fan wheel has a hub and a plurality of blades. The pressure-releasing portion is formed on free ends of the blades and has a stopping wall and a flange extending from one end of the stopping wall. A pressure-releasing channel is formed between the stopping wall and an inner wall of the frame body. With the pressure-releasing portion being formed on the free ends of the blades, the present invention is capable of delaying the deceleration, improving the fan performance, and reducing its noise.

3 Claims, 7 Drawing Sheets

FRAME ASSEMBLY OF RING-TYPE FAN WITH PRESSURE-RELEASING FUNCTION

BACKGROUND OF THE INVENTION

1. Field of the Invention

The present invention relates to a frame assembly of a ring-type fan, and in particular to a frame assembly of a ring-type fan with a pressure-releasing function, which is capable of delaying the deceleration, improving the fan performance, and reducing its noise.

2. Description of Prior Art

Nowadays, electronic products are gradually developed to have a high performance, a high frequency, a high speed, and a compact size. As a result, the amount of heat generated in the electronic product is increased to a greater extent, so that the operating state of such an electronic product becomes unstable and is always at a higher temperature, which affects the reliability and lifetime of the electronic product. Thus, it is an important issue for the manufacturers in this field to improve the heat dissipation for the electronic product. A fan is a common device used for this purpose.

Vortexes are often generated among blades of the fan during its operation. The vortexes affects the performance (such as the total air amount) of the fan. Thus, a ring-type fan is developed to solve this problem.

Please refer to FIGS. 1A and 1B showing a conventional ring-type fan. The conventional ring-type fan 1 includes a frame body 10 and a fan wheel 11. The frame 10 has an air-exiting side 101, an air-entering side 102 and a shaft portion 104. An accommodating space 12 is defined between the air-exiting side 101 and the air-entering side 102. The fan wheel 11 is disposed in the accommodating space 12. The shaft portion 104 is disposed in the center of the accommodating space 12 and pivotally connected to the fan wheel 11.

The fan wheel 11 has a hub 111 and a plurality of blades 112 circumferentially provided on the outer periphery of the hub 111. An annular body 14 is formed by connecting the free ends of the blades. A gap 15 is formed between the annular body 14 and the inner wall of the frame body 10. By this arrangement, when the fan is in operation, the annular body 14 can reduce the generation of vortexes among the blades 112, thereby improving the fan performance.

Although the conventional ring-type fan 1 can reduce the generation of vortexes by means of the annular body 14, another problem rises. Since the airflow enters the air-entering side 102 and exits the air-exiting side 101 when the ring-type fan 1 is operating, a negative pressure is generated on the air-exiting side 101. As a result, a portion of airflow exiting the air-exiting side 101 flows back and exits the annular body 14 via the gap 15. This portion of airflow exiting the annular boy 14 via the gap 15 will interference with the airflow entering the annular body 14, which causes turbulent flows on the air-entering side 102. As a result, the air entering the air-entering side 102 cannot flow smoothly, which reduces the fan performance and increases the noise.

According to the above, the conventional ring-type fan has the following drawbacks:

(I) reduced in the fan performance; and (II) increased in its noise.

In order to solve the above-mentioned problems, the present inventor proposes a novel and reasonable structure based on his expert knowledge and deliberate researches.

SUMMARY OF THE INVENTION

In order to solve the above problems, an objective of the present invention is to provide a frame assembly of a ring-type fan with a pressure-releasing function, which is capable of delaying the deceleration and increasing the fan performance.

Another objective of the present invention is to provide a frame assembly of a ring-type fan with a pressure-releasing function, which is capable of reducing its noise.

In order to achieve the above objective, the present invention is to provide a frame assembly of a ring-type fan with a pressure-releasing function, which includes a fan wheel, a pressuring-releasing portion, and a frame body. The frame body has an accommodating space for accommodating the fan wheel and a shaft portion. The shaft portion is formed in the center of the frame body and pivotally connected to the fan wheel. The fan wheel has a hub and a plurality of blades circumferentially provided on the outer periphery of the hub. Each of the blades has a fixing end and a free end extending from the fixing end. The fixing ends of the respective blades are connected to the outer periphery of the hub.

The pressure-releasing portion is formed on the free ends of the blades. The pressure-releasing portion has a stopping wall and a flange. The flange is formed by extending outwards from one end of the stopping wall. A pressure-releasing channel is formed between the stopping wall and an inner wall of the frame body. The structure of the present invention is capable of delaying the deceleration, improving the fan performance, and reducing its noise.

DETAILED DESCRIPTION OF THE INVENTION

The above objectives and structural and functional features of the present invention will be described in more detail with reference to preferred embodiment thereof shown in the accompanying drawings.

Figure 1A:
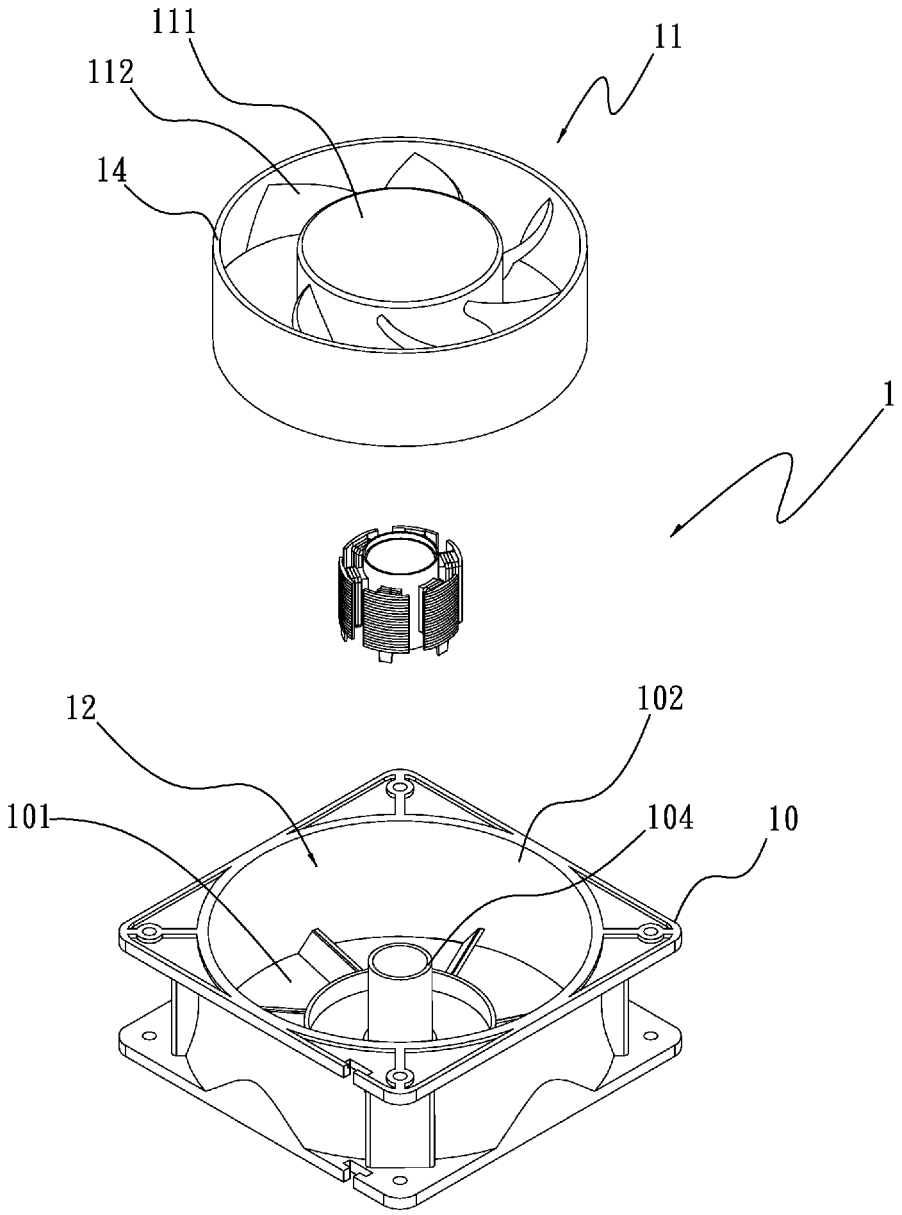
Fig. 1A(PRIOR ART)
FIG. 1A is an exploded perspective view of prior art.
Figure 1B:
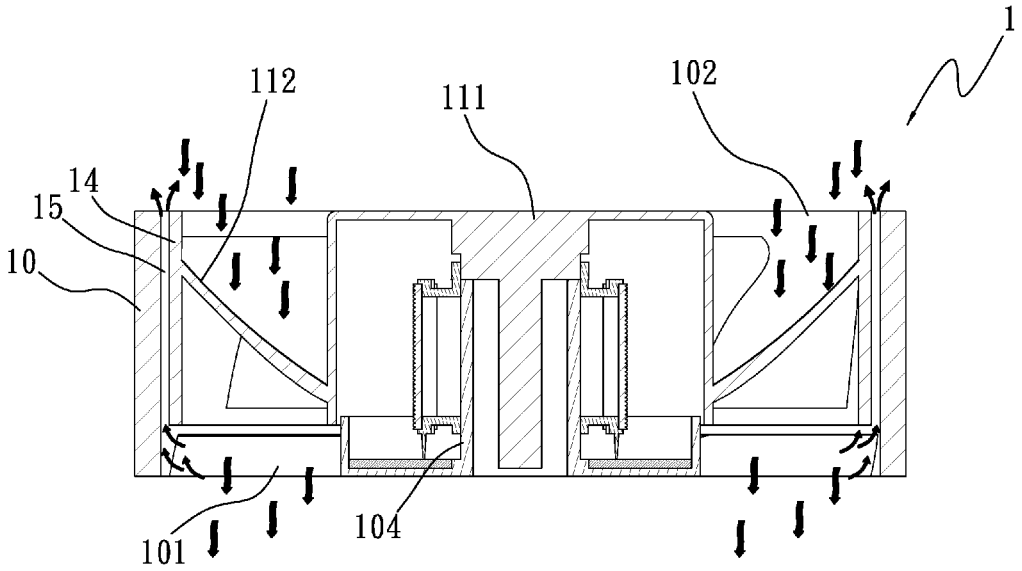
Fig. 1B(PRIOR ART)
FIG. 1B is an assembled cross-sectional view of prior art.
Figure 2:
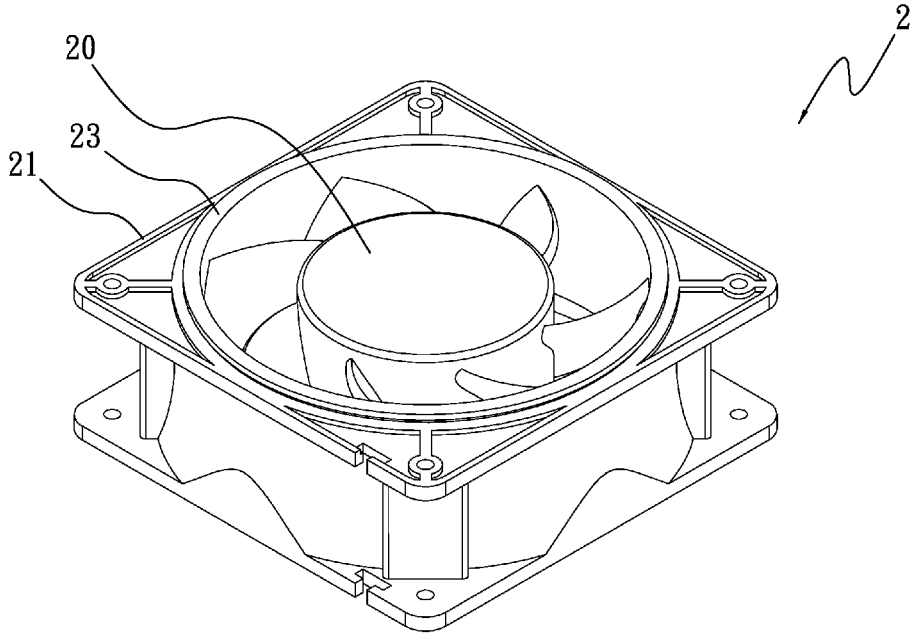
FIG. 2 is an assembled perspective view showing a first preferred embodiment of the present invention.
Figure 3:
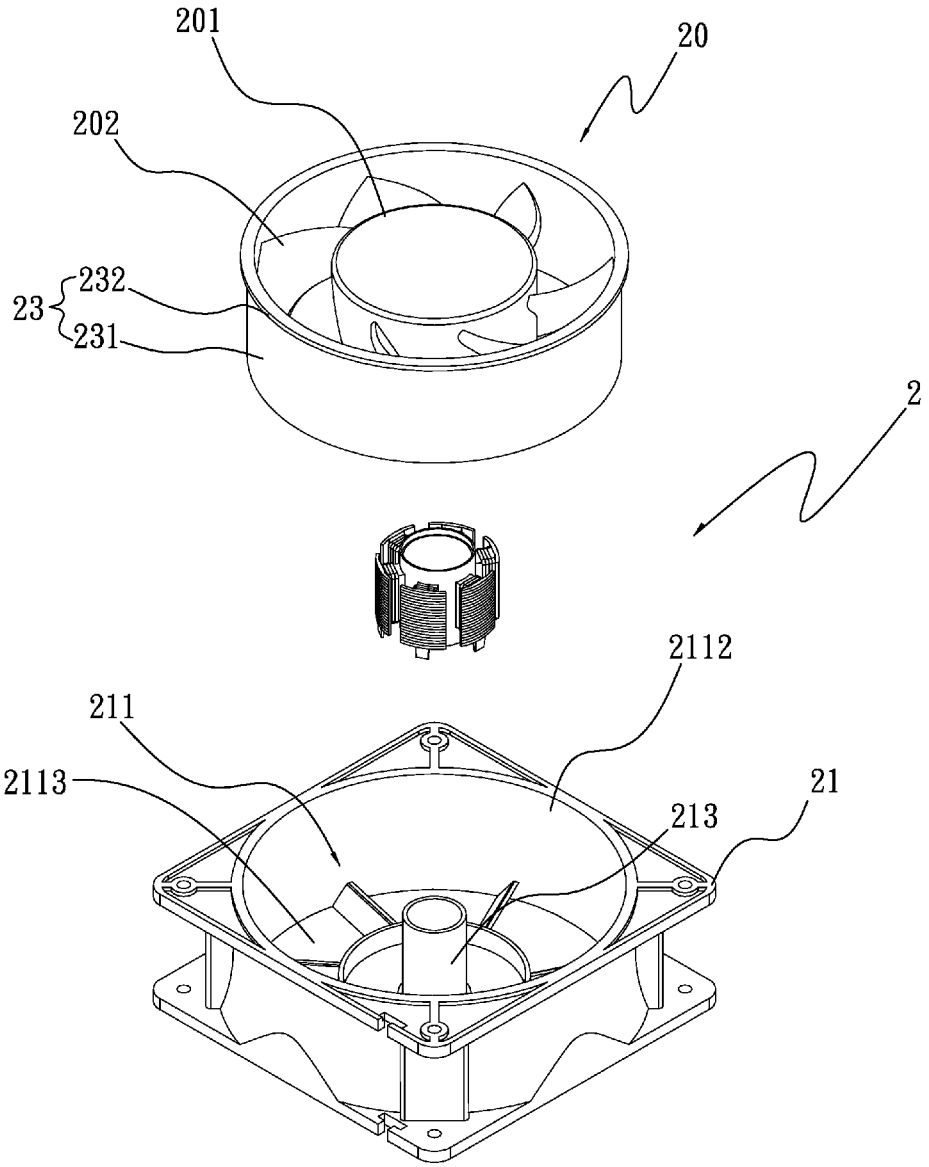
FIG. 3 is an exploded perspective view showing the first preferred embodiment of the present invention.
Figure 4:
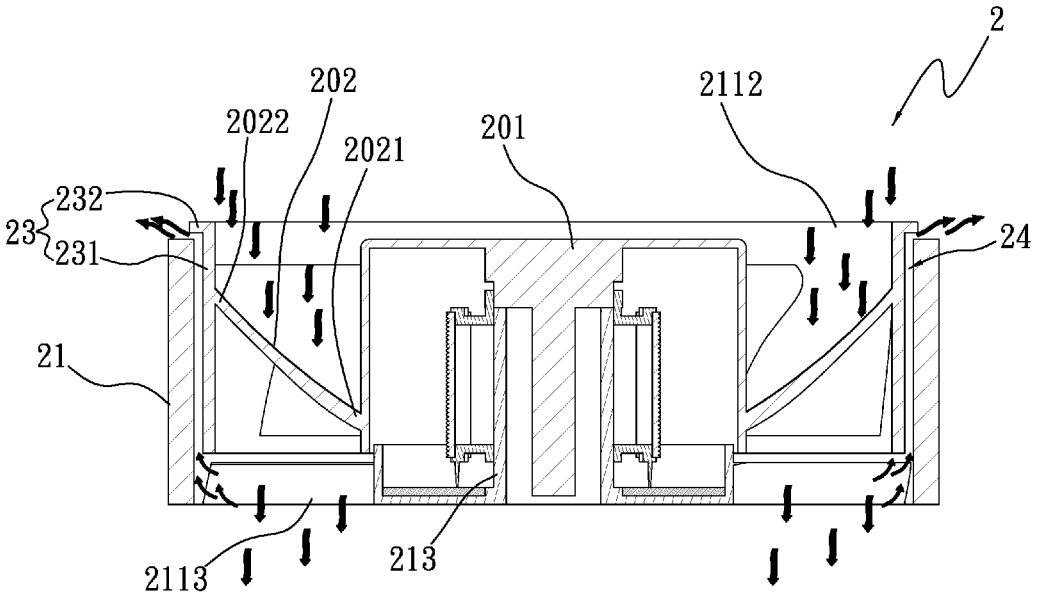
FIG. 4 is an assembled cross-sectional view showing the first preferred embodiment of the present invention.

The present invention provides a frame assembly of a ring-type fan with a pressure-releasing function. FIG. 2 is an assembled perspective view showing a first preferred embodiment of the present invention. FIG. 3 is an exploded perspective view showing the first preferred embodiment of the present invention. FIG. 4 is an assembled cross-sectional view showing the first preferred embodiment of the present invention. The frame assembly 2 of the ring-type fan includes a fan wheel 20, a frame body 21 and a pressure-releasing portion 23. The fan wheel 20 has a hub 201 and a plurality of blades 202 circumferentially provided on the outer periphery of the hub 201. Each of the blades 202 has a fixing end 2021 and a free end 2022. The fixing ends 2021 of the respective blades 202 are connected to the outer periphery of the hub 201 to form the fan wheel 20.

The frame body 21 has an accommodating space 211 and a shaft portion 213. The shaft portion 213 is formed in the center of the frame body 21 and pivotally connected to the fan wheel 20. The fan wheel 20 is received in the accommodating space 211. The accommodating space 211 has an air-entering side 2112 and an air-exiting side 2113. The accommodating space 211 is defined between the air-entering side 2112 and the air-exiting side 2113. By this structure, when the fan wheel 20 is operating, the external air flows into the air-entering side 2112 and is pressurized to exit the air-exiting side 2113.

The pressure-releasing portion 23 is formed on the free ends 2022 of the blades 202. In other words, the pressure-releasing portion 23 is integrated formed on the free ends 2022 of the blades 202 by an injection modeling process. The pressure-releasing portion 23 has a stopping wall 231 and a flange 232. The flange 232 is formed by extending outwards from one end of the stopping wall 231. As shown in FIG. 4, the flange 232 protrudes from one end of the stopping wall 231 adjacent to the air-entering side 2112 toward the outer periphery of the frame body 21. In the present embodiment, the flange 232 is suspended between the inner surface and the outer surface of the frame body 21. That is, the flange 232 is suspended on one end surface of the frame body 21 adjacent to the air-entering side 2112. However, the configuration of the flange 232 is not limited thereto. In order to conform to the practical demands for the pressure-releasing strength, the length of the flange 232 of the pressure-releasing portion 23 protruding from the frame body 21 can be changed to adjust the angle between the flange 232 and the stopping wall 231. For example, the angle between the flange 232 and the stopping wall 231 may be 90 degrees or 135 degrees.

Please refer to FIGS. 2 and 4 again. A pressure-releasing channel 24 is defined between the stopping wall 231 and the inner wall of the frame body 21. The pressure-releasing channel 24 is substantially formed into an L shape and in communication with the air-exiting side 2113. The pressure-releasing channel 24 is used to guide a reflowing portion of air generated on the air-exiting side 2113 to flow along the pressure-releasing channel 24 toward the pressure-releasing portion 23. After the reflowing portion of air flows into the pressure-releasing portion 23, the reflowing portion of air is guided to the outside via the flange 232 of the pressure-releasing portion 23, so that the reflowing portion of air will not interference with the airflow entering the air-entering side 2112. In this way, the fan of the present invention is capable of generating a smooth airflow, delaying the deceleration, improving the fan performance, and reducing the noise.

Figure 9:
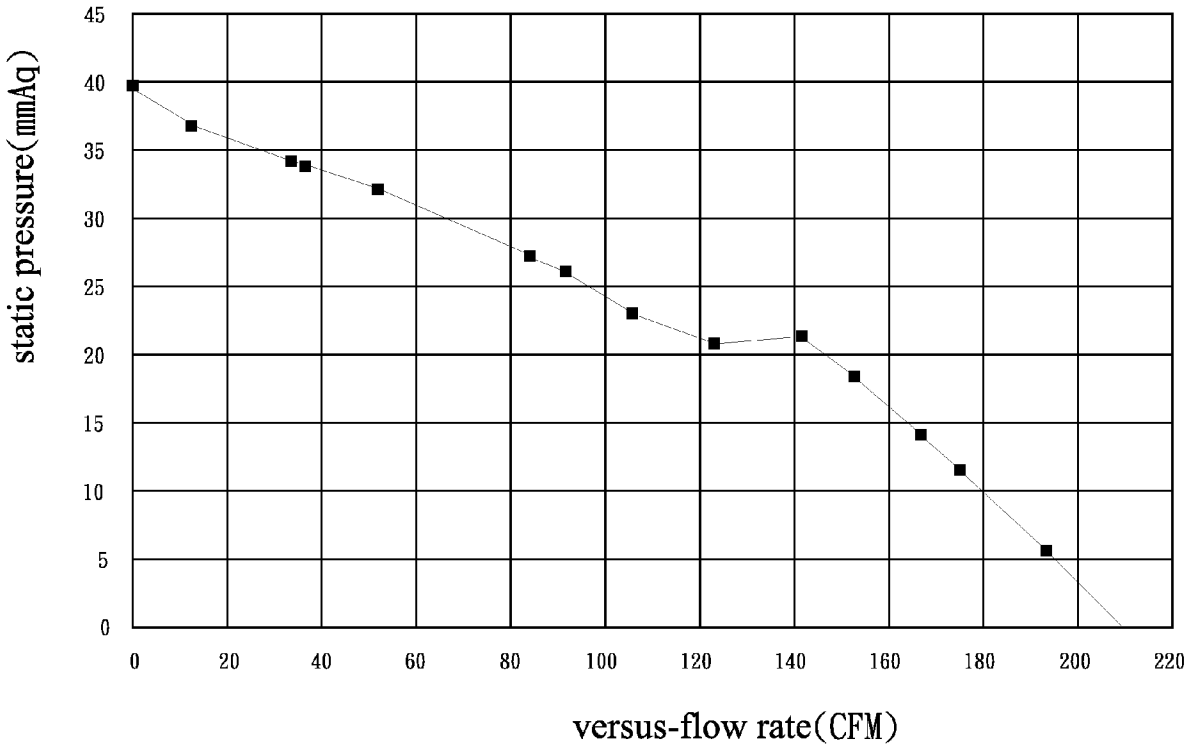
FIG. 9 is a schematic view showing the air volume curve of the fan of the present invention.

Please refer to FIG. 9, which is a schematic view showing the air volume curve (also referred to as a static pressure (P)-versus-flow rate (Q) curve) of the fan of the present invention. By means of the pressure-releasing portion 23, the P-Q curve shows the delay of the deceleration, increase the flow rate in the operation zone, and reduce the noise in the operation zone.

Figure 5:
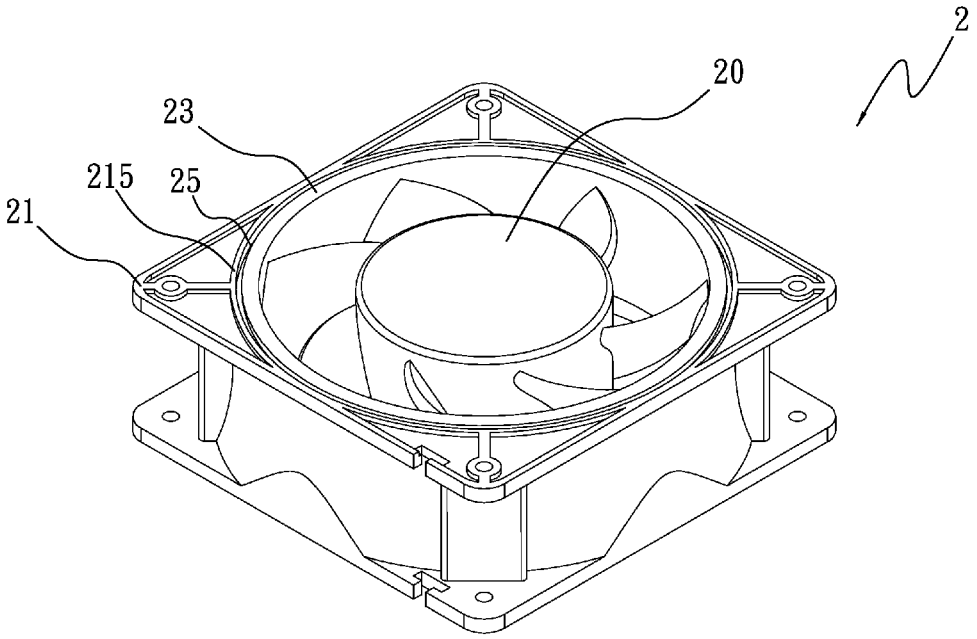
FIG. 5 is an assembled perspective view showing a second preferred embodiment of the present invention.
Figure 6:
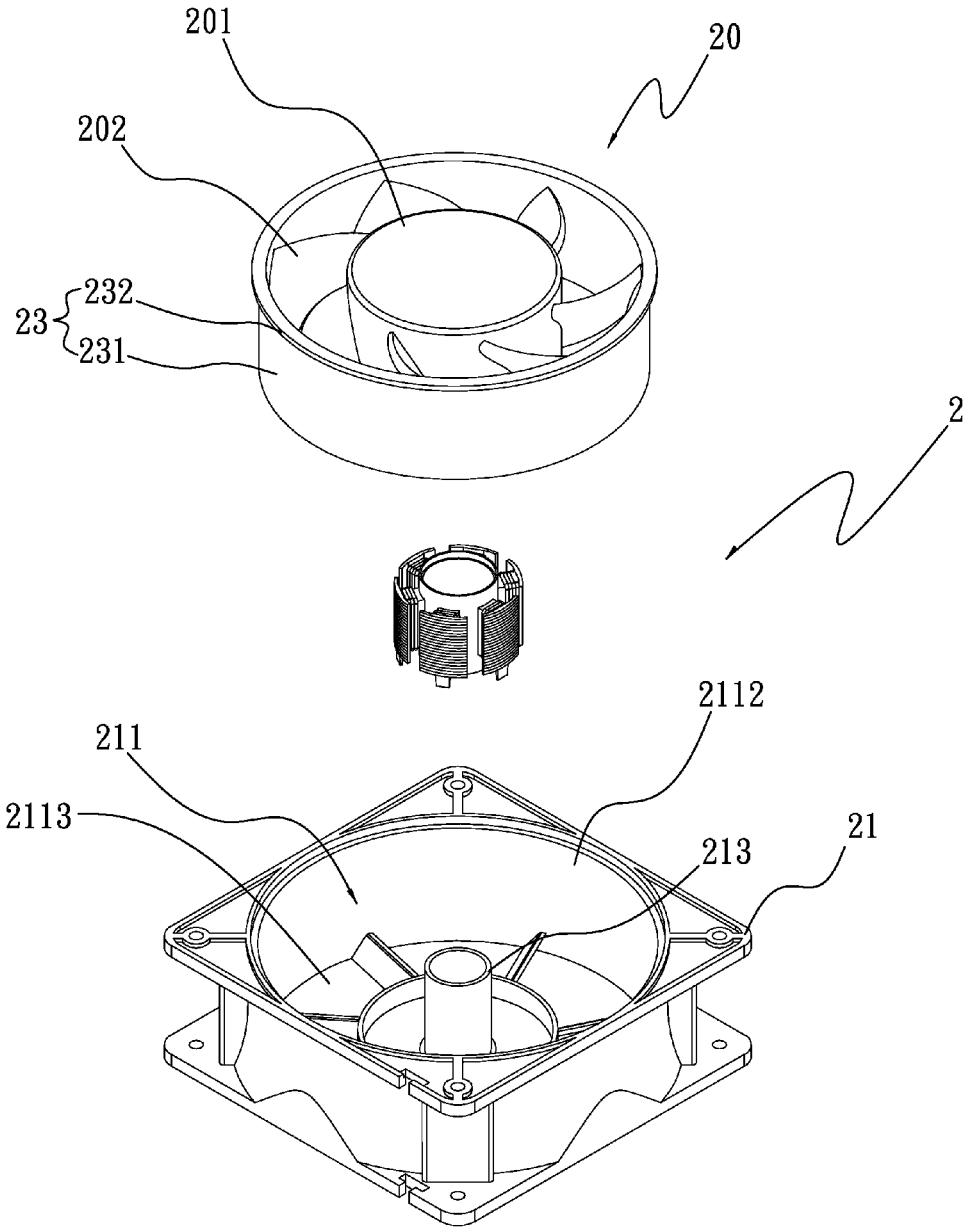
FIG. 6 is an exploded perspective view showing the second preferred embodiment of the present invention.
Figure 7:
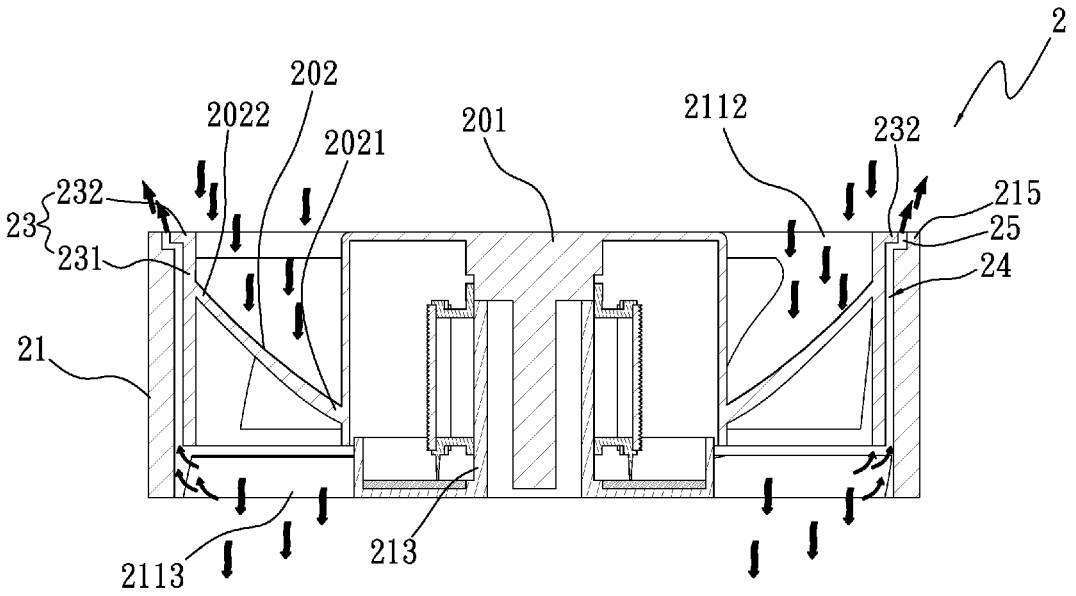
FIG. 7 is an assembled cross-sectional view showing the second preferred embodiment of the present invention.

Please refer to FIGS. 5, 6, and 7. FIG. 5 is an assembled perspective view showing a second preferred embodiment of the present invention. FIG. 6 is an exploded perspective view showing the second preferred embodiment of the present invention. FIG. 7 is an assembled cross-sectional view showing the second preferred embodiment of the present invention. The structure and the relationship among the components of the present embodiment are substantially the same as those of the first embodiment. Thus, the redundant description is omitted for clarity. The difference between the second embodiment and the first embodiment lies in that: the frame body 21 is provided on one side of the flange 232 with an extension portion 215 to face the flange 232. The extension portion 215 is formed by extending from one side of the frame body 21 to face the flange 232. The extension portion 215 and the flange 232 define a pressure-releasing port 25 in communication with the pressure-releasing channel 24.

Figure 8:
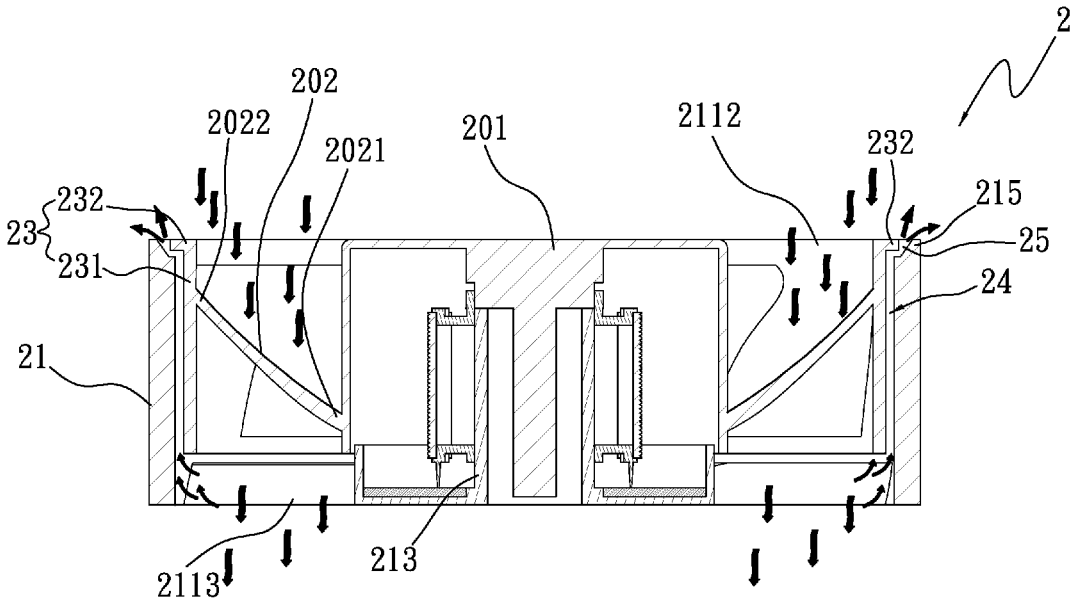
FIG. 8 is another assembled cross-sectional view showing the second preferred embodiment of the present invention.

The extension portion 215 can be formed into two aspects of construction. The first aspect of construction is as shown in FIG. 7, in which the extension portion 215 is formed by extending vertically from on side of the frame body 21 to face the flange 232, and the pressure-releasing port 25 is formed into a rectangular shape. It can be seen from FIG. 7 that, the pressure-releasing channel 24 and the pressure-releasing port 25 are in communication with each other to form a "ㄴ" shape or a stepped shape. The second aspect of construction is as shown in FIG. 8, in which the extension portion 215 is formed by extending outwards and obliquely from one side of the frame body 21 to face the flange 232, and the pressure-releasing port 25 is formed into an inclined shape. It can be seen from FIG. 8 that, the pressure-releasing channel 24 and the pressure-releasing port 25 are in communication with each other to form a "ㄴ" shape or a stepped shape.

According to the present invention, the pressure-releasing portion 23 is integrally formed on the free ends 2022 of the blades 202 of the fan wheel 20, and the fan wheel 20 is disposed in the frame body 21. Thus, the present invention is capable of delaying the deceleration and improving the fan performance.

According to the above, in comparison with prior art, the present invention has the following advantages:

(I) delayed in deceleration;

(II) improved in fan performance; and (III) reduced in its noise.

Although the present invention has been described with reference to the foregoing preferred embodiments, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. A frame assembly of a ring-type fan with a pressure releasing function, including:

a fan wheel having a hub and a plurality of blades, the blades being circumferentially provided on an outer periphery of the huh, each of the blades having a fixed end and a free end, the fixed ends of the blades being connected to an outer periphery of the hub;

a frame body having an accommodating space for accommodating the fan wheel therein and a shaft portion, the shaft portion being formed in the center of the frame body and pivotally connected to the fan wheel; and a pressure-releasing portion formed on the free ends of the blades, the pressure-releasing portion having a stopping wall and a flange extending outwards from one end of the stopping wall, a pressure-releasing channel being defined by the stopping wall and an inner wall of the frame body;

wherein one side of the frame body is provided with an extension portion to face the flanges the extension portion being obliquely extending from one side of the releasing port in communication with the pressure-releasing channel, a width of the pressure-releasing port being larger than that of the pressure-releasing channel; and wherein the pressure-releasing channel is substantially formed into an L shape.

2. The frame assembly of a ring-type fan with a pressure-releasing function according to claim 1, wherein the accommodating space is provided with an air-entering side and an air-exiting side, the air-entering side and the air-exiting side together define the accommodating space, the air-exiting side is in communication with the pressure-releasing channel.

3. The frame assembly of a ring-type fan with a pressure-releasing function according to claim 1, wherein the pressure-releasing portion is integrally formed on the free ends of the blades by an injection molding process.

* * * * *